US006453917B1

(12) United States Patent
Biechele

(10) Patent No.: US 6,453,917 B1
(45) Date of Patent: Sep. 24, 2002

(54) DISPENSING DEVICE FOR A LIQUID DISHWASHER DETERGENT

(75) Inventor: Guenter Biechele, Leutkirch (DE)

(73) Assignee: Aweco Appliance Systems GmbH & Co. KG, Neukirch (DE)

( * ) Notice: Subject to any disclaimer, the term of this patent is extended or adjusted under 35 U.S.C. 154(b) by 121 days.

(21) Appl. No.: 09/610,420

(22) Filed: Jul. 5, 2000

(30) Foreign Application Priority Data

Jul. 5, 1999 (DE) ..... 199 30 691

(51) Int. Cl.[7] ..... B08B 3/00; G01F 13/00

(52) U.S. Cl. ..... 134/99.2; 134/57 D; 222/252; 222/318; 222/424; 222/425

(58) Field of Search ..... 134/56 D, 57 D, 134/58 D, 96.1, 99.2; 222/252, 318, 424, 425, 630, 651

(56) References Cited

U.S. PATENT DOCUMENTS 3,370,597 A * 2/1968 Fox ..... 134/100.1
3,608,514 A * 9/1971 Dunn ..... 116/228
4,141,311 A * 2/1979 Taylor, Jr. ..... 116/227
4,164,197 A * 8/1979 Nelson ..... 116/227
5,176,297 A * 1/1993 Mooney et al. ..... 222/325

FOREIGN PATENT DOCUMENTS

DE 2638201 A1 * 3/1978

* cited by examiner

*Primary Examiner*—Randy Gulakowski
*Assistant Examiner*—Joseph Perrin
(74) *Attorney, Agent, or Firm*—Crowell & Moring LLP

(57) ABSTRACT

A dispensing device for dispensing liquid detergent in dishwashers is provided in which the detergent is fed into the wash area of the dishwasher only after the second actuation of the actuating member. This is achieved by providing: a barrier on the discharge side for the detergent in the operating position, which barrier is sequenced to follow a supply chamber. A return opening is provided to return the retained detergent in the fill position.

15 Claims, 2 Drawing Sheets

DISPENSING DEVICE FOR A LIQUID DISHWASHER DETERGENT

BACKGROUND AND SUMMARY OF THE INVENTION

This application claims the priority of German Application No. 199 30 691.5, filed Jul. 5, 1999, the disclosure of which is expressly incorporated by reference herein.

The invention relates to a dispensing device for liquid dishwasher detergent in dishwashers.

Dispensing devices in which an intermediate chamber or dispensing chamber is sequenced to follow a supply chamber for wetting agents are already known in dishwashers. In these, a double-valve plunger actuates in an opposing manner the valve function in the opening between supply chamber and dispensing chamber as well as that of the discharge opening of the dispensing chamber to the wash area of the dishwasher. This means that given a single application of current to the actuating solenoid valve, the opening between the supply chamber and dispensing chamber is opened and the outlet opening of the dispensing chamber is closed. During the transition to the de-energized state, the dispensing chamber is closed vis-á-vis the supply chamber, and the outlet opening is opened so that the wetting agent flows into the wash area. This arrangement with two chambers serves to specify, based on the specified volume of the dispensing chamber, a fixed dispensing volume such that with each application of current to the solenoid, wetting agent is also fed into the wash area of the dishwasher.

These dispensing devices are usually combined with a chamber to accommodate the detergent. This chamber is opened to feed the detergent into the wash cycle by a hinged door which is locked in its closed position and opened by spring pressure after an unlocking procedure. For reasons of cost, the unlocking procedure is effected by the same solenoid used to dispense the wetting agent. In order to maintain the program sequence of the wash process, specifically in terms of the feed of the appropriate detergent or wetting agent, it is necessary that only the hinged door of the detergent chamber be actuated during the initial application of current to the solenoid, and the dispensing of wetting agent be actuated only upon the subsequent application of current to the solenoid. In commercially available dishwashers, a lever arrangement with a ratcheting device is employed for this purpose. The ratcheting device causes the actuation lever for the wetting agent to click into place during the initial application of current, and the valve to actuate for the wetting agent only after the second application of current. When the dishwasher door is opened, the ratchet mechanism is returned to the starting position by gravity so that a wash program can start its sequence again from the beginning.

In contrast to the above, the object of the invention is to propose a dispensing device in which a detergent valve for dispensing wetting agent may be rigidly coupled to the actuating member while still allowing the wetting agent to enter the wash area only after a second actuation of the actuating member.

This object is achieved according to the invention with a dispensing device for dispensing liquid detergent in a wash area of a dishwasher in which a supply chamber for the detergent and a detergent valve are provided. The device is pivotable between a fill position and an operating position and is characterized in that provision is made for: in the direction of flow to the wash area behind the detergent valve, a dam to retain the detergent in the operating position and a return channel to return at least a portion of the retained detergent to the fill position.

Advantageous embodiments and further developments of the invention are described herein.

Accordingly, a dispensing device according to the invention is characterized in that provision is made for a dam behind the detergent valve in the direction of flow to the wash area, which dam is to retain the detergent in the operating position, and for a return channel for the return flow of at least a portion of the retained detergent in the fill position.

In this arrangement according to the invention, the retained volume in front of the dam is filled with detergent during the initial actuation of the actuating member, while a second function, e.g., unlocking a hinged door of a detergent chamber may be effected by the actuation member. The wetting agent retained by the dam cannot reach the interior of the wash area during this process. The dam may, as explained below, be designed in various ways such that wetting agent is able to override the barrier and reach the interior of the dishwasher only after the second actuation of the actuating member.

In order to reset the initial position of the dispensing device, it is necessary that the retained wetting agent be at least partially removed from the area in front of the dam when the dishwasher door is opened, for which purpose the return flow channel is provided. After the dispensing device has pivoted into the operating position, which action is usually effected when the dishwasher door is closed, the retained volume in front of the dam is again available for filling in response to the initial actuation of the actuating member.

In this type of dispensing device, the detergent valve may be rigidly joined to the actuating member, for example, to the armature of a solenoid.

The simultaneous actuation of the detergent valve along with an additional function, e.g., the opening of the hinged door of the detergent chamber, is permissible in the dispensing device according to the invention—with the result, for example, that the aforementioned lever arrangement may be dispensed with, or that the valve body of the dispensing valve may be designed to function simultaneously as the armature of the solenoid.

The dispensing device according to the invention may be employed in connection with any desired design for the actuating member and is not limited to the use of a preferred specific solenoid.

Additionally, the invention is of benefit not only in combination with a separate detergent chamber but also for any conceivable utilization in which the appropriate detergent is intended to be fed to the wash area of the dishwasher only after the second actuation of the detergent valve.

In one particular embodiment of the invention, the dam for the detergent is designed as an overflow. Here the actuation of the actuating member, for example, of a solenoid, must occur within the time period in which the level of the detergent does not exceed the height of the dam. With the next actuation of the detergent valve, the detergent is then able to override the overflow and reach the interior of the dishwasher.

In a preferred further development of the invention, the dam includes a discharge opening closable by discharge valve. Such a double valve arrangement is advantageous from the point of view of a failsafe design since it ensures that even if the first detergent valve is defective, no wetting agent can reach the area of the diaphragm which seals the detergent valve from the outside and which is usually present in previous dispensing devices.

The discharge valve may be actuated as a simple safety valve co-directionally to the detergent valve, which means that both valves open simultaneously and close simultaneously.

In one particular embodiment, however, the outlet valve may be coupled mechanically in opposition to the dispensing valve. This means that when the dispensing valve closing off the supply chamber opens, the discharge valve is closed and, conversely, when the dispensing valve is closed, the discharge valve opens.

This embodiment offers an advantageous combination of a dispensing chamber which encompasses the dam according to the invention. Upon the initial actuation of the actuating member, the discharge opening of the dispensing chamber is closed, while the detergent valve and thus the feed from the supply chamber is opened. In this position, detergent flows out of the supply chamber into the dispensing chamber.

Here, the dam is defined by the position of the discharge opening in the dispensing chamber. Said chamber must be designed sufficiently high that even after the actuating member is switched off, during which off-period the feed from the supply chamber is closed while the discharge opening of the dispensing chamber is open, no detergent reaches the area of the discharge opening but is instead retained in front of it at the wall of the dispensing chamber.

In response to the next actuation of the actuating member, the dispensing chamber may then be completely filled with the discharge opening closed. When the actuating member is subsequently switched off, the inlet from the supply chamber is again closed and the discharge opening opened once again. The detergent may now flow out into the wash area until the level in the interior of the dispensing chamber lies below the discharge opening. This dispensing process may be repeated as many times as needed, the available dispensing volume being the residual volume of the dispensing chamber immediately below the discharge opening. This dispensing volume corresponds to the total volume of the dispensing chamber minus the retained volume.

After the wash process is completed, the dishwasher is opened while the dispensing device pivots into position. In the process, at least a portion of the detergent in the dispensing chamber flows out through the return opening such that when the machine is operated once again, the volume retained in the dispensing chamber is at least partially available, and detergent may, according to the invention, only reach the wash area in response to the second actuation of the actuating member when the required actuation of the actuating member occurs.

In another embodiment, two additional chambers, i.e., an intermediate chamber and an outlet chamber, are sequenced to follow the supply chamber. Said outlet chamber here encompasses the dam according to the invention for the detergent. The additional chamber allows the intermediate chamber to be filled above the level of the closed discharge opening when the actuating member is first actuated. After the actuating member is switched off, the connection between the supply chamber and the intermediate chamber is interrupted, whereas the connection from the intermediate chamber to the outlet chamber is opened.

As a result, detergent then flows into the outlet chamber where it accumulates in front of the dam provided there.

The outlet chamber may in turn be provided with a discharge valve at the outlet, which valve is rigidly coupled to one or both of the aforementioned valves, the valve between the supply chamber and the intermediate chamber, as well as the intermediate valve between the intermediate chamber and the outlet chamber. The coupling may be implemented in such a way that the valves between the supply chamber and the intermediate chamber are opened and closed simultaneously with the discharge valve of the outlet chamber, while the valve between the intermediate chamber and the outlet chamber moves in the opposite direction. The entire arrangement may be designed as a system of communicating tubes.

When the actuating member is actuated, detergent flows from the supply chamber into the intermediate chamber, which is closed on the outlet side. After actuation is switched off, the detergent flows from the intermediate chamber, into the outlet chamber which is closed when a discharge valve is present or otherwise is provided with an overflow barrier.

When the actuating member is actuated again, the detergent is fed through in the same way—in the case of a discharge valve, the detergent in the outlet chamber can flow out during actuation of the actuating member; or in the case of an overflow barrier in the outlet chamber, the overflow overflows as soon as detergent flows through into the intermediate chamber after the actuating member switches off.

Said chambers need not necessarily be arranged next to one another in order to obtain an equalization of the detergent levels in them, but may be situated at different levels. In particular, it is possible, when the outlet chamber is used, to locate this chamber completely below the intermediate chamber so that the outlet chamber may be filled completely and used as a dispensing chamber.

Since in the case of an outlet chamber with a dam, the outlet chamber must also be reset to the start position when the dishwasher is opened, the outlet chamber is provided with a return opening so that the outlet chamber can empty at least partially when the dishwasher is opened.

The return flow of detergent when the dishwasher door is opened may, for example, proceed directly into the supply chamber for the detergent in each of the embodiments discussed.

Other objects, advantages and novel features of the present invention will become apparent from the following detailed description of the invention when considered in conjunction with the accompanying drawings.

DETAILED DESCRIPTION OF THE DRAWINGS

Figure 1:
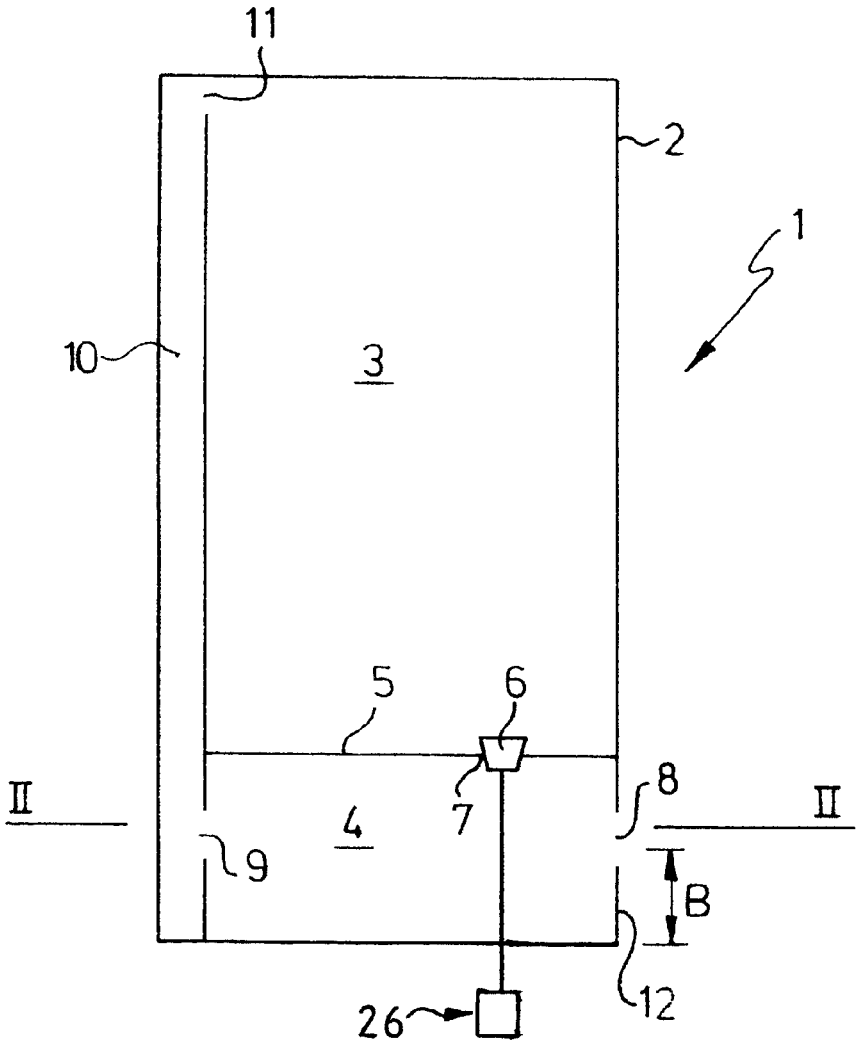
FIG. 1 is a longitudinal sectional diagram of a dispensing device according to the invention in the operating position.

The dispensing device 1 as shown in FIG. 1 encompasses a housing 2 in whose interior is located a supply chamber 3 for detergent. In the operating position as shown in FIG. 1, an outlet chamber 4 is formed below supply chamber 3 by a partition Outlet chamber 4 encompasses inlet opening 7 closable by a detergent valve 6, a discharge opening 8, as well as a return opening 9. Along the side next to return opening 9, there is a return channel 10, which exits into supply chamber 3 through an upper opening 11 at the top of the upper side of the supply chamber 3.

Discharge opening 8 of intermediate chamber 4 is located such that a wall section below it forms an overflow barrier 12 at level B.

Figure 2:
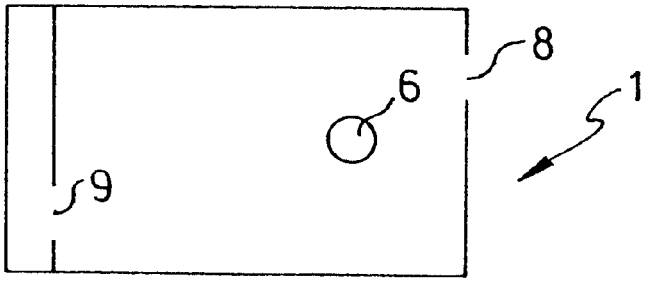
FIG. 2 is a lateral sectional diagram taken along line II—II of the dispensing device pivoted into the fill position.

In the pivoted fill position of dispensing device 1 as shown in FIG. 2, it is evident that discharge opening 8 and return opening 9 are laterally offset relative to one another so that when pivoted into the fill position, intermediate chamber 4 is not emptied through discharge 8 but through return 9 into supply chamber 3.

Operation of dispensing device 1 as shown in FIGS. 1 and 2 proceeds as follows. Upon initial actuation of an actuating member (not shown), e.g. a solenoid, in the operating position, detergent valve 6 opens so that detergent may flow into the interior of the mainly empty outlet chamber 4. The actuating member must be switched off again before the level of liquid inside outlet chamber 4 exceeds level B of barrier 12. This initial actuation of the actuating member may be employed for other purposes, for example for opening a detergent door.

When the actuating member is actuated once again, detergent valve 6 is again open; however, now the opening period is adjusted such that the detergent overflows overflow barrier 12 and can thus be discharged in the desired dispensing volume into the wash area of the dishwasher through opening 8. So long as intermediate chamber 4 has been filled to level B of overflow barrier 12, the discharge of detergent into the wash area occurs immediately when valve 6 opens.

This feeding of detergent into the dishwasher may be effected as often as deemed necessary for the program sequence of the wash process. After the wash program is completed, the dispensing device normally is pivoted along with the dishwasher door from the operating position as shown in FIG. 1 to the fill position as shown in FIG. 2 (i.e. dispenser rotates 90° out of the drawing page).

In this fill position, the detergent is usually refilled in the detergent chamber. When dispensing device 1 is pivoted, the detergent still retained by overflow barrier 12 in outlet chamber 4 flows back through return opening 9 and return channel 10 into supply chamber 3 so that outlet chamber 4 is at least partially emptied. Emptying need not necessarily be complete; to enable functioning according to the invention, it is sufficient for the detergent level inside outlet chamber 4 to be lowered to that level below overflow barrier 12 at which a sufficient period for the operation of valve 6 is enabled without any overflow of detergent over overflow barrier 12.

When provision is made for an additional valve to close discharge opening 8, which valve acts in the opposite direction to detergent valve 6, the volume of outlet chamber 4 above level B of dam 1 may be utilized as dispensing volume. For this purpose, in response to the second actuation of the valves, outlet chamber 4 is completely filled while discharge opening 8 is closed. After detergent valve 6 closes and discharge opening 8 opens, the detergent located above level B is discharged.

Another embodiment of the invention is shown in FIGS. 3*a* through 3*d*. Dispensing device 13 shown in these illustrations comprises three chambers, a supply chamber 14, an intermediate chamber 15, and an outlet chamber 16. The three chambers are separated by partitions 17 and 18. Three valve bodies 19, 20, 21 act to open or close inlet opening 22 of intermediate chamber 15, outflow opening 23 of intermediate chamber 15, and outlet opening 24 of outlet chamber 16. All three valve bodies 19, 20, 21 are attached to a common plunger 25. Valve body 19 between supply chamber 14 and intermediate chamber 15, as well as valve body 21 at outlet opening 24 of outlet chamber 16, open and close simultaneously. Valve body 20 between intermediate chamber 15 and outlet chamber 16 opens or closes in the opposite direction.

Figure 3A:
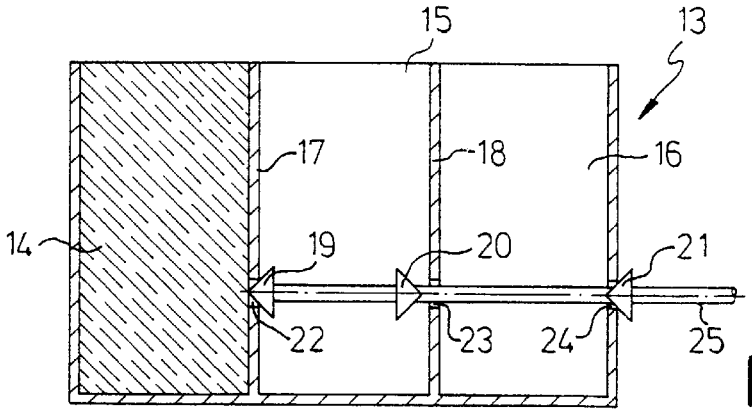
FIG. 3*a*–3*d* are sectional diagrams of different operating phases during the operation of a second embodiment of a dispensing device according to the invention.
Figure 3B:
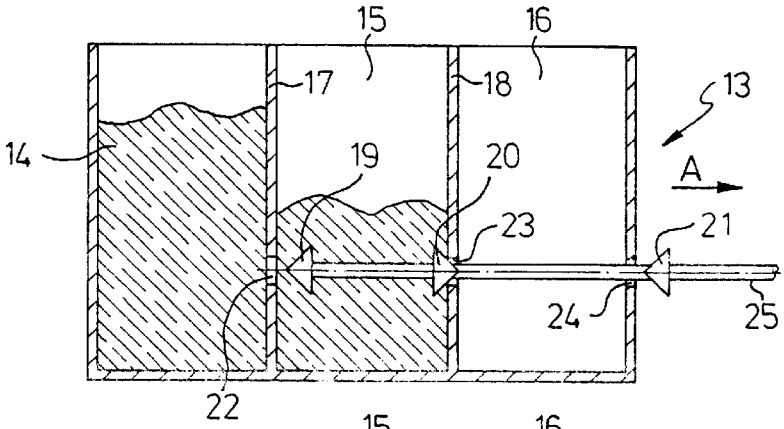

FIG. 3*a* shows the initial condition with supply chamber 14 filled, and both intermediate chamber and outlet chamber 16 empty. Valve body 19 here closes off partition 17.

Upon actuation of an actuating member (not shown), plunger 25 is pulled in the direction of arrow A. Inlet opening 22 of intermediate chamber 15 now opens, while discharge opening 23 closes. The level of liquid in supply chamber 14 drops while intermediate chamber 15 fills. Outlet chamber 16 remains empty, thereby ensuring that no detergent can pass through outlet opening 24 and reach the wash area of the dishwasher.

Figure 3C:
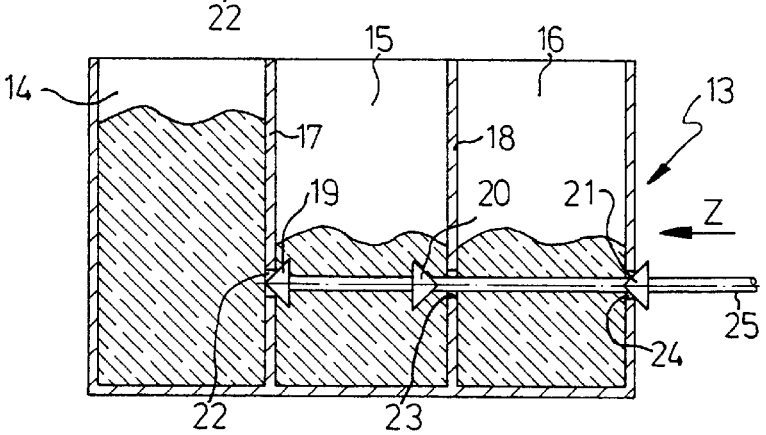
Figure 3D:
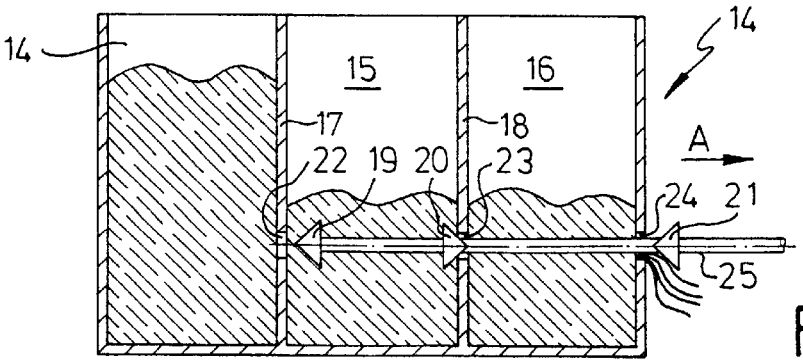

During the next phase as shown in FIG. 3*c*, the actuating member is switched off so that plunger 25 returns in the direction of arrow Z to its position of FIG. 3*a*. Here, inlet opening 22 between supply chamber 14 and intermediate chamber 15 also closes, as does outlet opening 24 of outlet chamber 16. The opening of discharge opening 22 of intermediate chamber 15 creates a uniform level of liquid between intermediate chamber 15 and outlet chamber 16.

Upon the next actuation of the actuating member, plunger 25 is again actuated in the direction of arrow A, as a result of which detergent can, in the above-described manner, flow through open inlet opening 22 from supply chamber 14 into intermediate chamber 15. At the same time, however, outlet chamber 16 empties through outlet opening 24 into the interior of the wash area of the dishwasher.

After actuation of the actuating member is completed, plunger 25 returns to its position as shown in FIG. 3*c*, whereupon there occurs another equalization of fluid levels in previously filled intermediate chamber 15 and previously emptied outlet chamber 16.

This arrangement based on the principle of communicating tubes also ensures the functioning of the solution according to the invention, i.e., the solution by which the dispensing of detergent into the interior of the dishwasher is effected only in response to the second actuation of the actuating member.

In a further development of this embodiment, supply chamber 14, intermediate chamber 15, and outlet chamber 16 may also be located at different levels. Here it is, for example, possible in principle to create an outlet chamber 16 by properly selecting the volumes of individual chambers 14, 15 and 16, as well as the arrangement of openings 22, 23 and 24, which outlet chamber is completely filled and completely, or up to a defined residual volume, emptied, and thus usable as a dispensing chamber.

In this multi-chamber design as shown in FIGS. 3*a* through 3*d*, or in related further developments of said multi-chamber designs, a return flow must also be provided in order to reestablish the initial situation as shown in FIG. 3*a* —in this case of outlet chamber 16, after completion of the wash process and the return pivoting of dispensing device 13 into the fill position.

Table of Reference Numbers

1 dispensing device
2 housing
3 supply chamber

4 outlet chamber
5 partition
6 detergent valve
7 inlet opening
8 discharge opening
9 return opening
10 return channel
11 upper opening
12 overflow barrier
13 dispensing device
14 supply chamber
15 intermediate chamber
16 outlet chamber
17 partition
18 partition
19 valve body
20 valve body
21 valve body
22 inlet opening
23 discharge opening
24 outlet opening
25 plunger
26 actuating member foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A dispensing device for dispensing liquid detergent in a wash area of a dishwasher, the dispensing device having a supply chamber for the detergent and a detergent valve, the dispensing device comprising:

a dam member provided in the dispensing device downstream of the detergent valve in the detergent flow direction to the wash area, said dam member being operable to retain the detergent in an operating position of the dispensing device;

a return channel arranged in the dispensing device to return at least a portion of the detergent retained by the dam member when the dispensing device is in a fill position; and wherein said dispensing device is pivotable between the fill position and the operating position.

2. The dispensing device according to claim 1, further comprising a separate chamber containing an actuating member for the detergent.

3. The dispensing device according to claim 2, further comprising a solenoid as the actuating member.

4. The dispensing device according to claim 3, further comprising a coupling member provided between the actuating member of the separate chamber for the detergent and the detergent valve.

5. The dispensing device according to claim 2, further comprising a coupling member provided between the actuating member of the separate chamber for the detergent and the detergent valve.

6. The dispensing device according to claim 1, wherein said dam member comprises an overflow-type dam member.

7. The dispensing device according to claim 1, wherein said dam member comprises a discharge opening closable by a discharge valve.

8. The dispensing device according to claim 7, wherein the discharge valve and the detergent valve are mechanically coupled.

9. The dispensing device according to claim 1, wherein a dispensing chamber is provided.

10. The dispensing device according to claim 1, further comprising an outlet chamber containing the dam member, an intermediate chamber, and the supply chamber, wherein said outlet chamber is sequenced to follow the intermediate chamber and the supply chamber.

11. The dispensing device according to claim 10, wherein said outlet chamber includes an outlet valve.

12. The dispensing device according to claim 11, wherein said outlet valve is rigidly coupled to an intermediate chamber valve and the detergent valve.

13. The dispensing device according to claim 10, wherein said outlet chamber includes a return opening.

14. The dispensing device according to claim 13, wherein the outlet chamber forms a dispensing chamber.

15. The dispensing device according to claim 10, wherein the outlet chamber forms a dispensing chamber.

* * * * *